US010073400B2

(12) United States Patent
Tomino

(10) Patent No.: US 10,073,400 B2
(45) Date of Patent: Sep. 11, 2018

(54) IMAGE FORMATION DEVICE

(71) Applicant: Konica Minolta, Inc., Chiyoda-ku, Tokyo (JP)

(72) Inventor: Toshiaki Tomino, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/466,154

(22) Filed: Mar. 22, 2017

(65) Prior Publication Data

US 2017/0277105 A1 Sep. 28, 2017

(30) Foreign Application Priority Data

Mar. 24, 2016 (JP) ..... 2016-060754

(51) Int. Cl.
*G03G 15/00* (2006.01)

(52) U.S. Cl.
CPC ..... *G03G 15/6529* (2013.01)

(58) Field of Classification Search
CPC ..... G03G 2215/00223; G03G 2215/00227; G03G 2215/00455; G03G 2215/00459
See application file for complete search history.

(56) References Cited

U.S. PATENT DOCUMENTS

2010/0150583 A1* 6/2010 Hitaka ..... G03G 15/553 399/28
2015/0071671 A1* 3/2015 Kiuchi ..... G03G 15/5062 399/72

FOREIGN PATENT DOCUMENTS

JP 5741656 B2 7/2015

* cited by examiner

*Primary Examiner* — Clayton E Laballe
*Assistant Examiner* — Jas Sanghera
(74) *Attorney, Agent, or Firm* — Cantor Colburn LLP

(57) ABSTRACT

An image formation device includes: an image formation section configured to develop, using toner, an electrostatic latent image formed on an image carrier based on job image information, thereby transferring a first image onto continuous paper; a hardware processor configured to determine whether or not a serial printing distance is equal to or shorter than a first threshold, wherein the serial printing distance is a distance at which the first image is printed on the continuous paper, and control the image formation section to print the first image on the continuous paper when the serial printing distance is equal to or shorter than a first threshold, and to decrease the proportion of deteriorated toner in a developer by printing the first image and a second image on the continuous paper when the serial printing distance exceeds a first threshold, wherein the second image is based on an image information.

15 Claims, 8 Drawing Sheets

IMAGE FORMATION DEVICE

CROSS REFERENCE TO RELATED APPLICATIONS

The entire disclosure of Japanese Patent Application No. 2016-060754 filed on Mar. 24, 2016 including description, claims, drawings, and abstract are incorporated herein by reference in its entirety.

BACKGROUND OF THE INVENTION

Field of the Invention

The present invention relates to an image formation device.

Description of the Related Art

Typically, an image formation device employing an electrophotographic technique, such as a printer or a copying machine, has been broadly used. In the image formation device, image formation processing has been generally performed via the following series of process: a photosensitive drum having a uniformly-charged surface is irradiated with laser light by an optical device such that an electrostatic latent image is written on the photosensitive drum; and, after the electrostatic latent image has been developed using toner in a developer, the developed toner image is transferred onto paper via an intermediate transfer belt, and then, the transferred toner image is fixed onto the paper.

It has been known that the toner is deteriorated when the toner has not been consumed for a long period of time, for example. There is a problem that a decrease in the amount of charging of the toner and lowering of an image quality are caused due to toner deterioration. The toner discharge processing of forcibly discharging, to the outside, the deteriorated toner accumulated in the developer has been typically performed as countermeasures to the above-described problem. For example, in image formation on each piece of paper (each flat sheet), the deteriorated toner is discharged in such a manner that, for example, a band-shaped pattern is formed on the intermediate transfer belt at the timing at which image formation is not performed between adjacent pieces of paper.

However, in image formation on elongated continuous paper such as a paper roll, there is no region where, for example, the band-shaped pattern can be formed between adjacent images, and for this reason, there is a problem that the deteriorated toner cannot be discharged. Thus, JP 5741656 B2 describes an image formation device configured to forma predetermined image pattern in a side region of continuous paper outside an image formation region such that an area coverage is equal to or greater than a predetermined threshold, thereby promoting toner circulation to reduce toner deterioration.

However, in, for example, the image formation device described in JP 5741656 B2, the following problem is caused. That is, for discharging deteriorated toner, printing needs to be performed using toner in the side region on the continuous paper. For this reason, the image formation region is narrowed by such printing. As a result, a printing distance on the paper unnecessarily increases, leading to a problem that the paper is wastefully consumed.

SUMMARY OF THE INVENTION

The present invention has been made in view of the above-described problems, and an object thereof is to provide an image formation device configured so that deteriorated toner can be discharged without wasting paper when continuous paper is used.

To achieve the abovementioned object, according to an aspect, an image formation device reflecting one aspect of the present invention comprises: an image formation section configured to develop, using toner, an electrostatic latent image formed on an image carrier based on job image information, thereby transferring a first image onto continuous paper; a hardware processor configured to determine whether or not a serial printing distance is equal to or shorter than a first threshold, wherein the serial printing distance is a distance at which the first image is printed on the continuous paper, and control the image formation section to print the first image on the continuous paper when the serial printing distance is equal to or shorter than a first threshold, and to decrease the proportion of deteriorated toner in a developer by printing the first image and a second image on the continuous paper when the serial printing distance exceeds a first threshold, wherein the second image is based on an image information, different from the job image information; an image formation section configured to develop, using toner, an electrostatic latent image formed on an image carrier based on job image information, thereby transferring a first image onto continuous paper; a hardware processor configured to control the image formation section to print, on the continuous paper, the first image and a second image for discharging deteriorated toner when a printing distance at which the first image is printed on the continuous paper exceeds a first threshold.

The first threshold is preferably a value indicating a distance at which the first image is printable without discharging deteriorated toner regardless of a coverage of the first image.

The coverage is preferably contained in the image information.

The hardware processor preferably determines whether or not the printing distance exceeds the first threshold.

The hardware processor preferably controls the image formation section not to print the second image on the continuous paper when the printing distance is equal to or shorter than the first threshold.

The image formation section preferably includes an intermediate transfer belt and a cleaning section configured to remove toner from the intermediate transfer belt, and the hardware processor preferably controls the image formation section to transfer the second image onto the intermediate transfer belt and remove the second image by the cleaning section under suspension of printing of the first image when the printing distance is equal to or shorter than the first threshold.

The image information is preferably transmitted from an external device.

The hardware processor preferably controls the image formation section to print, on the continuous paper, the first image and the second image when the printing distance exceeds a second threshold greater than the first threshold.

The hardware processor preferably determines the second threshold based on a coverage of the first image.

The hardware processor preferably increases the second threshold with an increase in the coverage.

The hardware processor preferably controls the image formation section to form the second image at an end portion of the continuous paper in a direction perpendicular to a delivery direction of the continuous paper.

The hardware processor preferably controls the image formation section to form the first image on an inner side of the second image.

The hardware processor preferably determines a printing width or a printing distance of the second image based on a coverage of the first image.

When the printing distance exceeds a second threshold greater than the first threshold, the hardware processor preferably determines, based on user's selection, whether the second image is, together with the first image, printed on the continuous paper to discharge deteriorated toner or the deteriorated toner is discharged without printing the second image on the continuous paper.

To achieve the abovementioned object, according to an aspect, a non-transitory computer readable medium reflecting one aspect of the present invention includes an instruction for making an image formation device execute a toner discharging method, and the method includes: determine whether or not a serial printing distance is equal to or shorter than a first threshold, wherein the serial printing distance is a distance at which a first image is printed on the continuous paper, the first image is based on job image information and control the image formation section to print the first image on the continuous paper when the serial printing distance is equal to or shorter than a first threshold, and to decrease the proportion of deteriorated toner in a developer by printing the first image and a second image on the continuous paper when the serial printing distance exceeds a first threshold, wherein the second image is based on an image information, different from the job image information.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
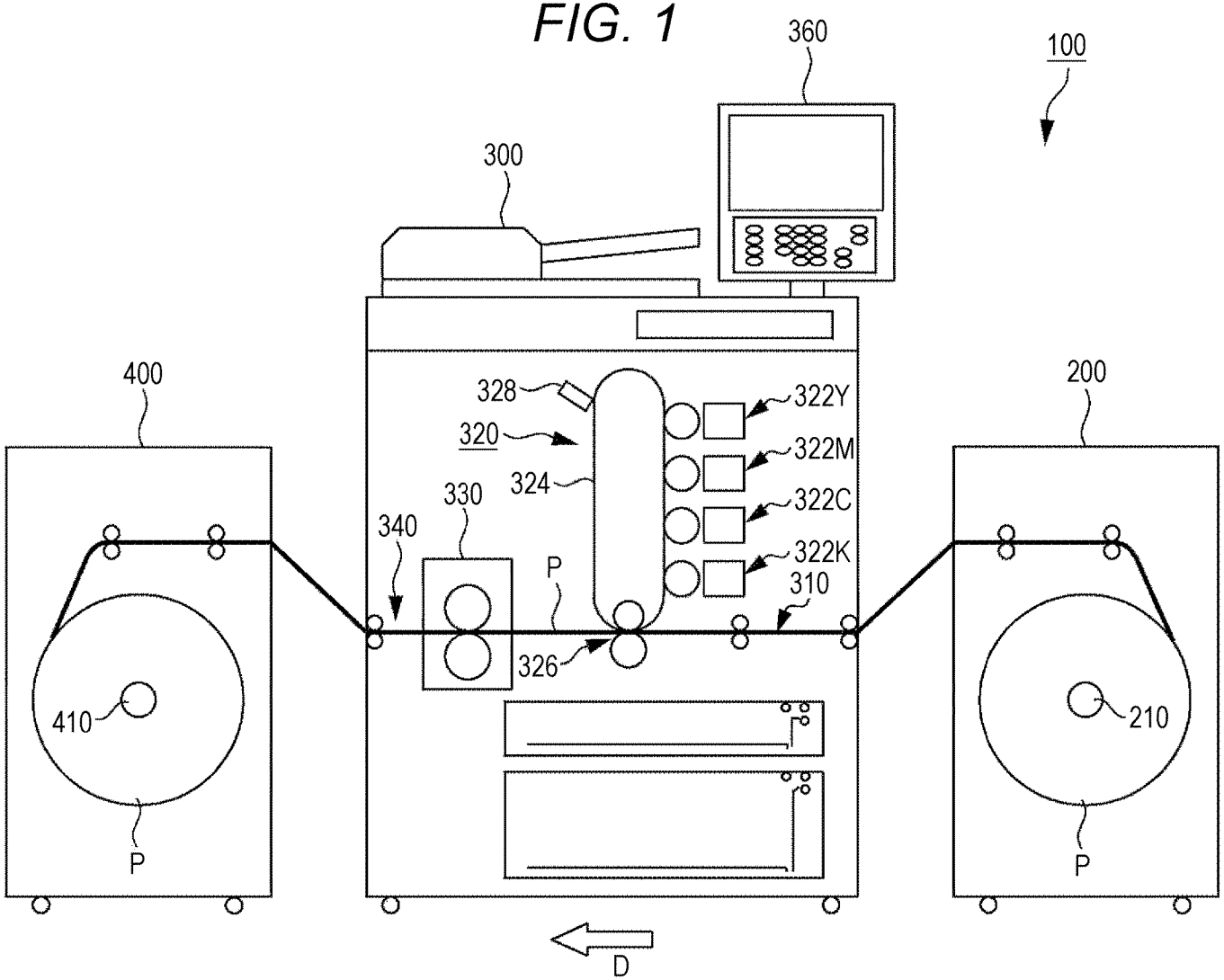
FIG. 1 is a view of a configuration example of an image formation system of an embodiment of the present invention.

Hereinafter, preferred embodiments of the present invention will be described in detail with reference to the drawings. However, the scope of the invention is not limited to the illustrated examples. Moreover, a dimension ratio in the drawings is exaggerated for the sake of description, and might be different from an actual ratio.

First Embodiment

Configuration Example of Image Formation System 100

FIG. 1 illustrates an example of a schematic configuration of an image formation system 100 of an embodiment of the present invention. As illustrated in FIG. 1, the image formation system 100 is configured to form an image on continuous paper such as a paper roll P. The image formation system 100 includes a paper supply device 200, an image formation device 300, and a paper discharge device 400.

The paper supply device 200 is disposed on an upstream side of the image formation device 300 in a paper delivery direction D, and has a loading section 210 with a support shaft. The loading section 210 is configured to rotatably support the wound paper roll P to send out the paper roll P to the image formation device 300 based on the instruction of starting a job. The paper roll P is, for example, a label-printable paper roll, and includes a mount and a printing surface bonded via a seal member. Note that the continuous paper is not necessarily held in a roll shape, and may be folded. Alternatively, a plurality of pieces of elongated continuous paper may be used.

The image formation device 300 is a tandem color electrophotographic copying machine, and includes a paper supply delivery section 310, an image formation section 320, a fixing section 330, a paper discharge delivery section 340, and an operation display section 360.

The paper supply delivery section 310 includes, for example, a plurality of delivery rollers and a drive motor configured to rotatably drive these rollers. The paper supply delivery section 310 is configured to rotate, by driving by the drive motor, the plurality of delivery rollers, thereby delivering the paper roll P from the paper supply device 200 to the image formation section 320.

The image formation section 320 includes an image formation section 322Y for yellow, an image formation section 322M for magenta, an image formation section 322C for cyan, an image formation section 322K for black, an intermediate transfer belt 324, and a secondary transfer section 326. Note that the image formation section 322Y, 322M, 322C, 322K for each color includes a charging section, an exposure section, a development section, a photosensitive drum, and the like, but a well-known technique can be employed. For this reason, detailed description of these sections will not be made. Toner images in the above-described colors are formed by the image formation sections 322Y, 322M, 322C, 322K, and are transferred to overlap with each other at an image formation position of the intermediate transfer belt 324. In the secondary transfer section 326, the toner images in the above-described colors on the intermediate transfer belt 324 are collectively transferred onto the paper roll P delivered by the paper supply delivery section 310.

The fixing section 330 includes, for example, a fixing roller, a pressure roller, and a fixing belt. The fixing section 330 is configured to fix, by heating and pressurizing, the toner images onto a surface of the paper roll P onto which the toner images are transferred by the secondary transfer section 326.

The paper discharge delivery section 340 includes, for example, a plurality of delivery rollers and a drive motor configured to rotatably drive these rollers. The paper discharge delivery section 340 is configured to rotate, by driving by the drive motor, the plurality of delivery rollers to deliver the paper roll P to the later-stage paper discharge device 400, the paper roll P being subjected to fixing processing in the fixing section 330.

The operation display section 360 includes a touch panel having a combination of a display section and an input section, and an operation key having a start key and an enter key provided at the periphery of the touch panel. The operation display section 360 is configured to display an operation screen and the like and to receive various types of information such as an image formation condition input by touch operation on the operation screen and the like or operation of the operation key.

The paper discharge device 400 includes a roll-up section 410 disposed on a downstream side of the image formation device 300 in the paper delivery direction D and having a support shaft. The roll-up section 410 is configured to roll up the paper roll P about the support shaft, the paper roll P being discharged from the paper discharge delivery section 340 of the image formation device 300. The paper roll P is not necessarily rolled up in a roll shape, and can be housed in such a shape that the paper roll P is cut into each page.

Note that an adjustment device (a buffer) configured to absorb, for example, a difference between the speed of delivery of the paper roll P in the paper supply device 200 and the speed of delivery of the paper roll P in the image formation device 300 may be provided between the paper supply device 200 and the image formation device 300. Moreover, a similar adjustment device may be provided between the image formation device 300 and the paper discharge device 400. Further, an adjustment mechanism may be, as a unit, attached to a side portion of the image formation device 300 near a carry-in section or a carry-out section thereof. In addition, a processing device configured to perform, for example, label cutting or laminating for the paper roll P on which the image has been printed may be provided between the image formation device 300 and the paper discharge device 400.

Block Configuration Example of Image Formation Device 300

Figure 2:
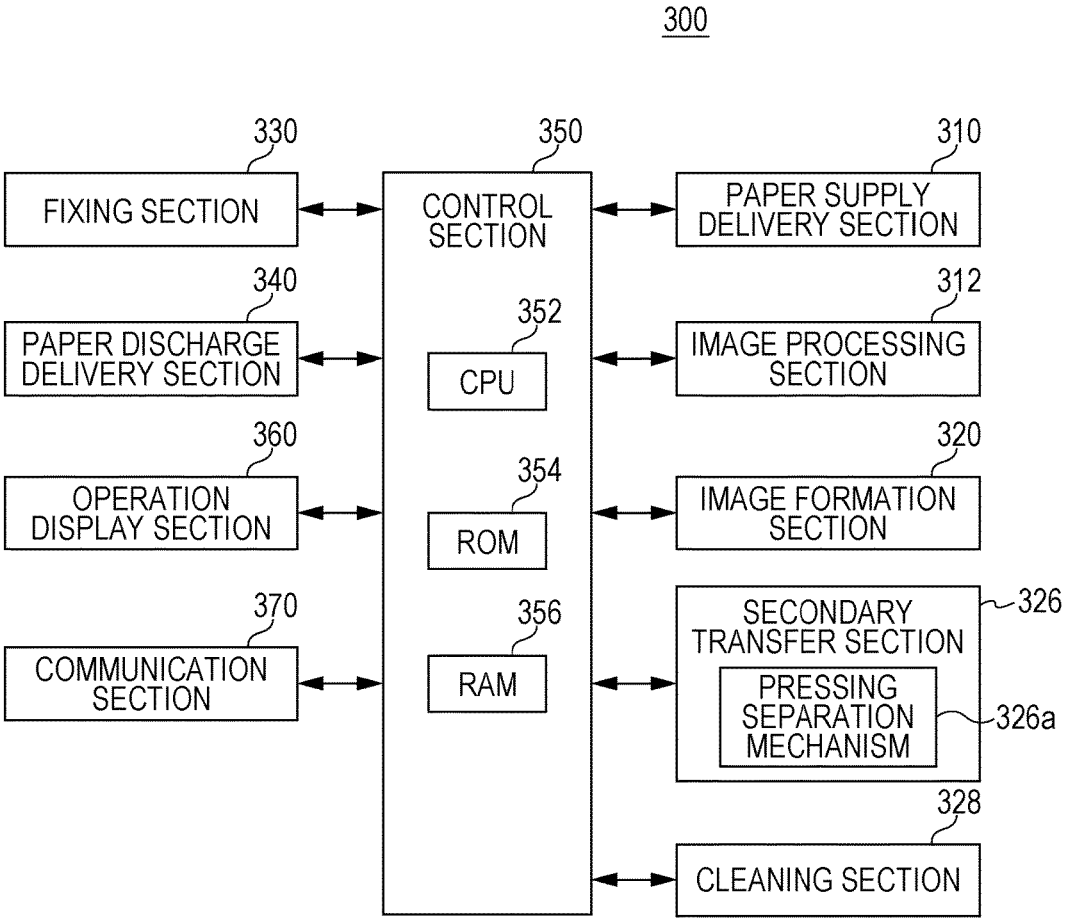
FIG. 2 is a block diagram of a functional configuration example of an image formation device.

FIG. 2 is a block diagram of an example of a functional configuration of the image formation device 300 in the image formation system 100 of the present invention. As illustrated in FIG. 2, the image formation device 300 includes a control section 350 configured to control operation of the entirety of the system. The control section 350 includes a central processing unit (CPU) 352, a read only memory (ROM) 354, and a random access memory (RAM) 356. The CPU 352 is configured to decompress and execute, in the RAM 356, software (a program) read from the ROM 354, thereby controlling each section of the image formation device 300 to implement a function regarding image formation.

The following sections are each connected to the control section 350: the paper supply delivery section 310, an image processing section 312, the image formation section 320, the secondary transfer section 326, a cleaning section 328, the fixing section 330, the paper discharge delivery section 340, the operation display section 360, and a communication section 370. The paper supply delivery section 310, the image processing section 312, the image formation section 320, the fixing section 330, the paper discharge delivery section 340, the operation display section 360, and the like execute predetermined processing based on an instruction from the control section 350.

The secondary transfer section 326 includes a pressing separation mechanism **326*a*. The pressing separation mechanism 326*a* includes a cam, a gear, a motor, and the like, and is configured to press a secondary transfer roller against an opposing roller or separate the secondary transfer roller from the opposing roller based on a drive signal supplied from the control section 350**.

The cleaning section 328 includes a plate-shaped blade, and is configured to remove an image pattern formed for deteriorated toner discharging on the intermediate transfer belt 324 and toner remaining in image formation while contacting a surface of the intermediate transfer belt 324.

The communication section 370 is an interface for communication with other external devices (e.g., a host device incorporating a printer driver) via a network such as a local area network (LAN) or a wide area network (WAN). A standard such as the Ethernet (the registered trademark), Wi-Fi, FDDI, and a token ring is used for communication.

Figure 3:
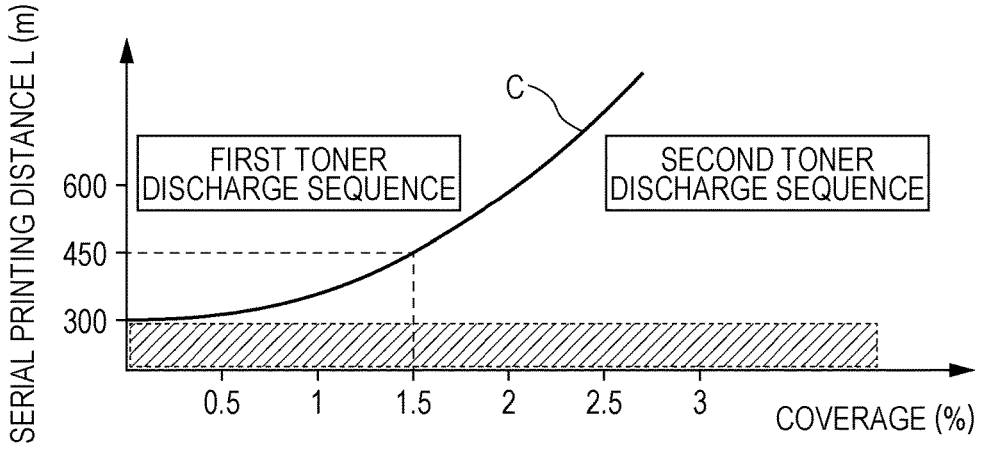
FIG. 3 is a graph for describing the method for selecting a toner discharge sequence.

Example of Relationship of Image Coverage and Serial Printing Distance with Method for Discharging Deteriorated Toner FIG. 3 is a graph for describing a relationship of an image coverage and a serial printing distance with the method for discharging the deteriorated toner. In FIG. 3, the vertical axis represents the serial printing distance at which an image is serially printed, and the horizontal axis represents the image coverage. The serial printing distance is a printing distance at which one job is serially printed without interruption.

As shown in FIG. 3, when the serial printing distance in a job to be executed is equal to or shorter than 300 m (indicated by a shaded portion), serial printing can be, regardless of the image coverage, performed without printing the image pattern for deteriorated toner discharging on the paper roll P. In the present example, such a serial printing distance is referred to as a "first threshold Th1." For example, even when the image coverage is 0%, but the serial printing distance is equal to or shorter than 300 m, serial image printing can be performed based on the job without printing the deteriorated toner on the paper roll P. Note that the first threshold Th1 is not limited to 300 m, and is optionally changeable according to various parameters such as toner properties, use environment, and device properties.

A serial printing threshold curve C is a curve defined based on the serial printing distance and the image coverage, and a first toner discharge sequence or a second toner discharge sequence is selected as the method for discharging the deteriorated toner with reference to such a curve.

For example, a reference serial printing distance is, with reference to the serial printing threshold curve C, determined from the image coverage of the job to be executed. In the present example, the reference serial printing distance is referred to as a "second threshold Th2." The second threshold Th2 is a value greater than the first threshold Th1 as the minimum printing distance and indicating a serial printing distance at which the deteriorated toner needs to be discharged in relation to the image coverage. Subsequently, a serial printing distance L obtained from image information of the job to be executed and the second threshold Th2 are compared with each other, and the first or second toner discharge sequence is selected based on a comparison result.

Note that the serial printing threshold curve C can be set based on, for example, experiment and prediction before device shipping.

The first toner discharge sequence described herein is the processing of printing, on the paper roll P, the image pattern for discharging the deteriorated toner according to the image coverage during serial image printing operation when the serial printing distance L exceeds the second threshold Th2.

Moreover, the second toner discharge sequence described herein is the following processing: when the serial printing distance L is equal to or shorter than the second threshold Th2, the serial image printing operation is performed without printing the image pattern for deteriorated toner discharging on the paper roll P, and an electrostatic latent image formed on the photosensitive drum is developed using toner after cessation around the time of the serial printing operation or in the middle of the serial printing operation; and then, the image pattern for deteriorated toner discharging is transferred onto the intermediate transfer belt 324, and is removed by the cleaning section 328.

For example, when the image coverage obtained from the image information of the job is 1.5%, 450 m is calculated as the second threshold Th2 from the serial printing threshold curve C. Subsequently, the serial printing distance L is obtained from the image information of the job to be executed. The first toner discharge sequence is executed when the serial printing distance L exceeds 450 m, and the second toner discharge sequence is executed when the serial printing distance is equal to or shorter than 450 m.

Operation Example of Image Formation Device 300

Figure 4:
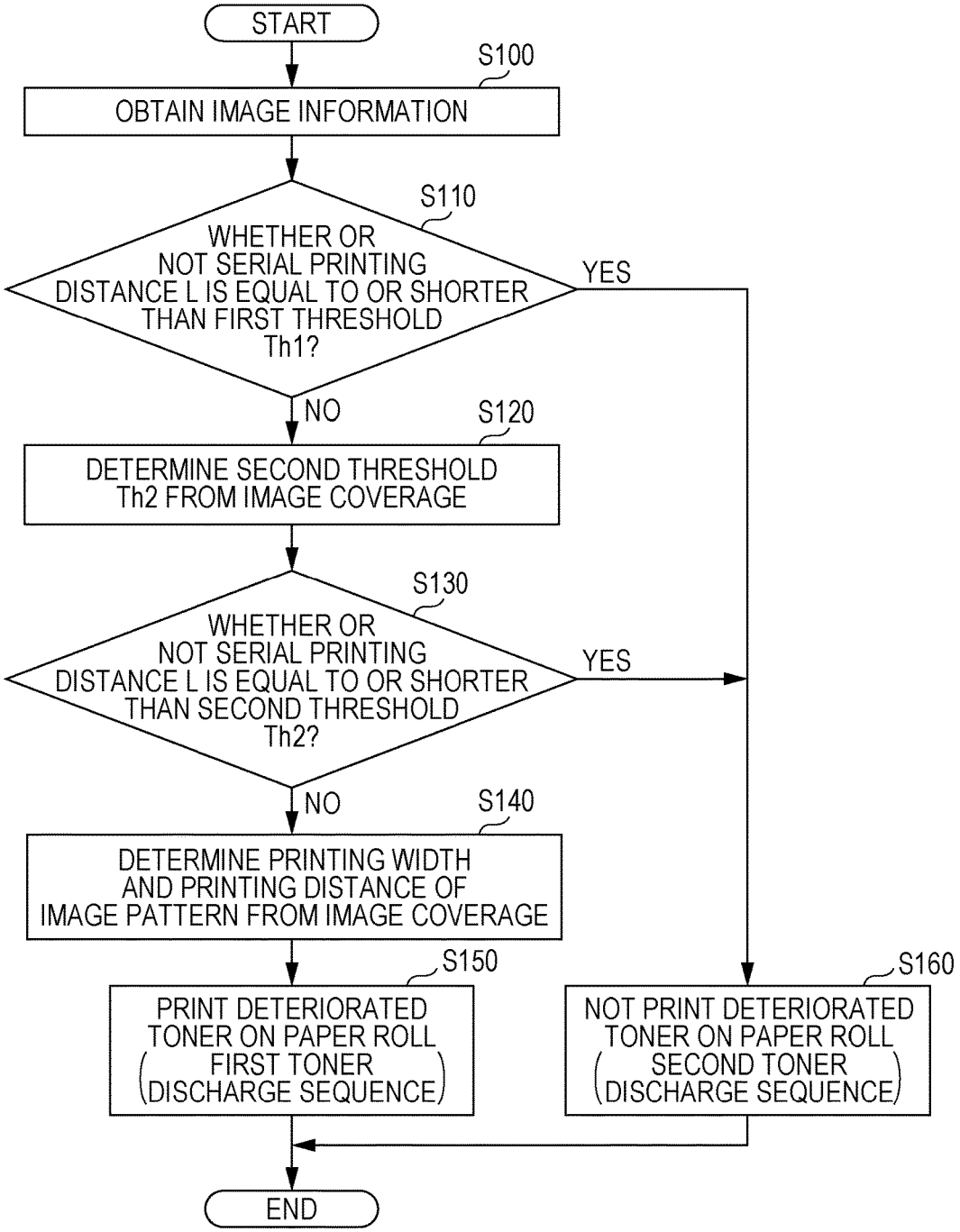
FIG. 4 is a flowchart of an operation example of the image formation system of a first embodiment of the present invention.

FIG. 4 is a flowchart of an example of operation of the image formation device 300 in the case of discharging the deteriorated toner. The CPU 352 of the image formation device 300 executes the software read from the ROM 354 to implement processing shown in the flowchart of FIG. 4.

As shown in FIG. 4, the control section 350 obtains, at a step S100, a job transmitted from a not-shown external device such as a computer to extract and obtain image information contained in the obtained job. The image information contains, for example, printing sheet number information and printing image coverage information. The control section 350 uses the printing sheet number information obtained from the image information to calculate the serial printing distance L at which an image is serially printed in the job. Upon completion of the step S100, the processing proceeds to a step S110.

At the step S110, the control section 350 reads the pre-stored first threshold Th1 from, for example, the memory to determine whether or not the calculated serial printing distance L is equal to or shorter than the preset first threshold Th1. When the control section 350 determines that the serial printing distance L is equal to or shorter than the first threshold Th1, the serial printing distance L is a distance at which serial image printing can be, regardless of the image coverage, performed in execution of the job without discharging the deteriorated toner. Thus, the processing proceeds to a step S160. On the other hand, when it is determined that the serial printing distance L exceeds the first threshold Th1, the processing proceeds to a step S120.

When it is determined that the serial printing distance L exceeds the first threshold Th1, the control section 350 determines (calculates), at the step S120, the second threshold Th2 from the serial printing threshold curve C shown in FIG. 3 based on the image coverage obtained from the image information. Upon completion of the step S120, the processing proceeds to a step S130.

At the step S130, the control section 350 further determines whether or not the serial printing distance L in the job is equal to or shorter than the second threshold Th2. When the control section 350 determines that the serial printing distance L in the job is equal to or shorter than the second threshold Th2, the serial printing distance L is a distance at which serial image printing can be performed in execution of the job without discharging the deteriorated toner. Thus, the processing proceeds to the step S160. On the other hand, when it is determined that the serial printing distance L in the job exceeds the second threshold Th2, the serial printing distance L is a printing distance at which a defective image or the like occurs in relation to the image coverage as long as the deteriorated toner is not discharged in execution of the job. Thus, the processing proceeds to a step S140.

When it is determined that the serial printing distance L in the job exceeds the second threshold Th2, the control section 350 determines, at the step S140, the printing width and printing distance (length) of the image pattern for deteriorated toner discharging according to the image coverage before execution of the first toner discharge sequence. Upon completion of the step S140, the processing proceeds to a step S150.

At the step S150, the control section 350 controls the image formation section 320 and the like in association with execution of the job to print the image on the paper roll P based on the image information (image data) while executing the first toner discharge sequence of printing the determined image pattern for deteriorated toner discharging on the paper roll P.

Figure 5:
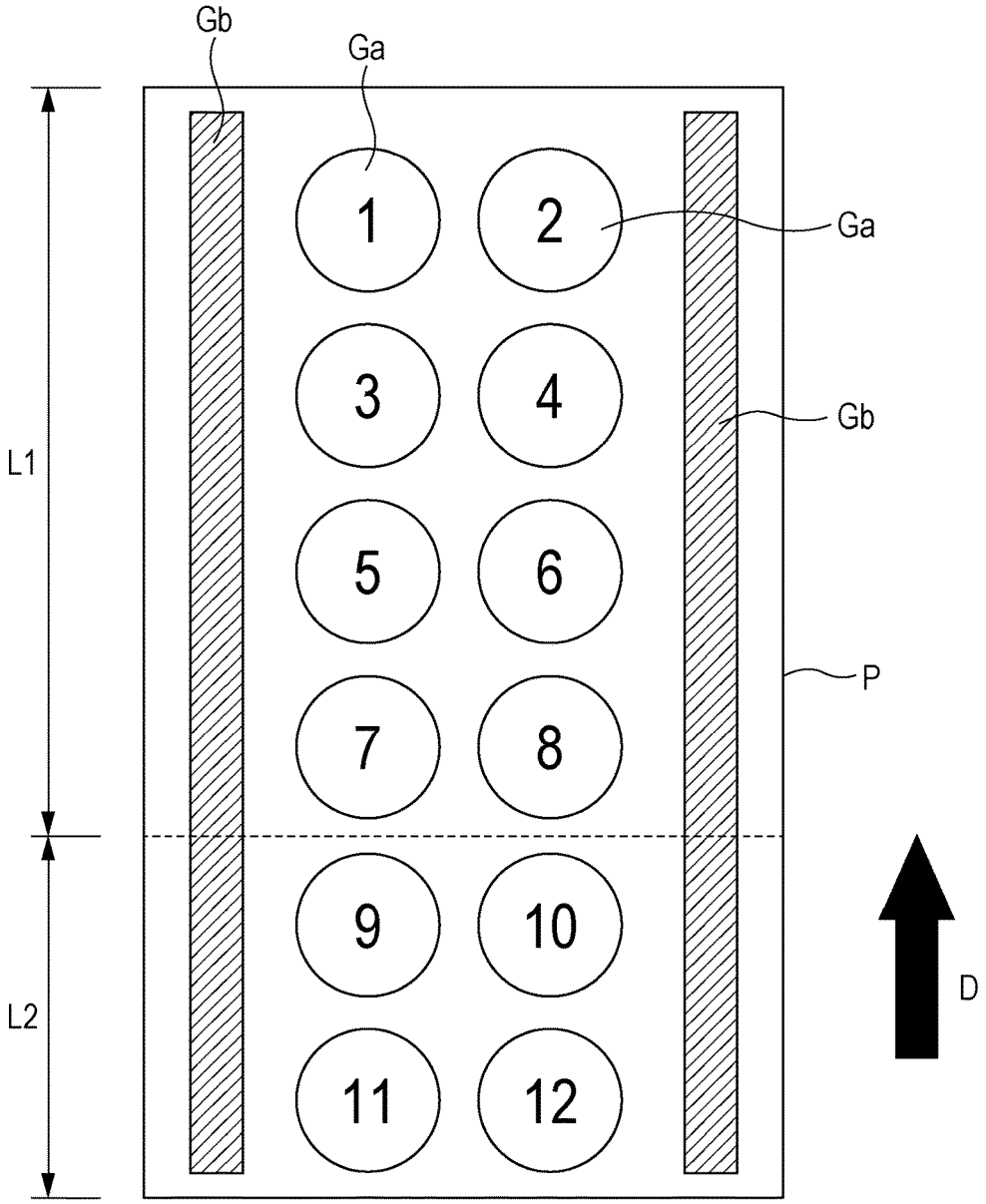
FIG. 5 is a view of normal images and image patterns for toner discharging in a first toner discharge sequence.

FIG. 5 illustrates an example of a configuration of normal images Ga and image patterns Gb for deteriorated toner discharging on the paper roll P in the first toner discharge sequence. As illustrated in FIG. 5, the image formation section 320 prints each of images Ga1 to Ga12 on the paper roll P. The images Ga1 to Ga12 are formed at equal intervals in two columns and six rows, for example. Moreover, the image formation section 320 prints, in a non-image formation region outside the images Ga1 to Ga12, the image patterns Gb for deteriorated toner discharging respectively at both end portions of the paper roll P in a direction perpendicular to the paper delivery direction D. Each image pattern Gb for deteriorated toner discharging includes, for example, a band-shaped pattern extending in the paper delivery direction D. The image printing distance on the paper roll P is L1+L2.

Referring back to FIG. 4, when it is determined that the serial printing distance L is equal to or shorter than the first threshold Th1 or the second threshold Th2, the control section 350 controls, at the step S160, the image formation section 320 and the like in association with execution of the job to print the image on the paper roll P based on the image information while executing the second toner discharge sequence of not printing the image pattern for deteriorated toner discharging on the paper roll P.

Figure 6:
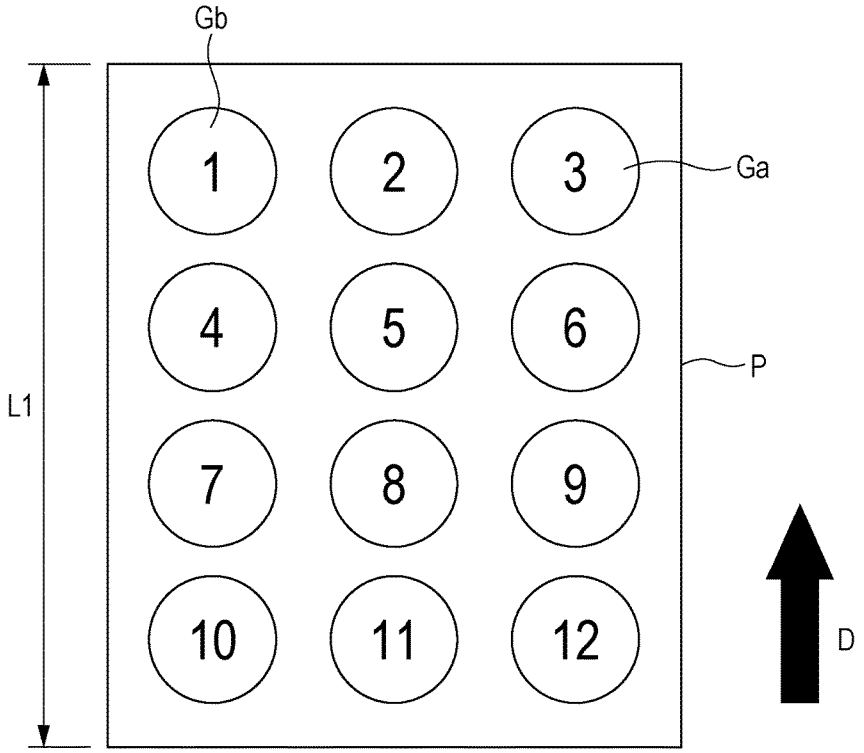
FIG. 6 is a view of a configuration example of the normal images in a second toner discharge sequence.

FIG. 6 illustrates an example of the configuration of the normal images Ga on the paper roll P in the second toner discharge sequence. As illustrated in FIG. 6, the image formation section 320 prints each of the images Ga1 to Ga12 on the paper roll P in association with execution of the job. It is not necessary to print the image patterns Gb (see FIG. 5) for deteriorated toner discharging, and therefore, the images Ga1 to Ga12 are formed at equal intervals in three columns and four rows, for example. Moreover, the image printing distance on the paper roll P is L1.

As described above, according to a first embodiment, when the serial printing distance L is equal to or shorter than the first threshold Th1 as the minimum printing distance or when the serial printing distance L is equal to or shorter than the second threshold Th2 determined according to the image coverage, the images Ga as the job are serially printed without printing the image patterns Gb for deteriorated toner discharging on the paper roll P. With this configuration, the image patterns Gb for deteriorated toner discharging are not printed, and therefore, an image formation region where the images Ga are printed can be expanded by these image patterns Gb. Thus, wasting of the paper roll P can be prevented.

More specifically, the deteriorated toner discharge sequence illustrated in FIG. 5 has been typically performed even when the serial printing distance L is equal to or shorter than the first and second thresholds Th1, Th2. However, in the first embodiment, the deteriorated toner discharge sequence illustrated in FIG. 6 is performed, and therefore, wasting of the paper roll P can be reduced by the length L2 of the paper roll P.

Moreover, according to the first embodiment, it is not necessary to print the image patterns Gb other than the regular images Ga on the paper roll P, and therefore, a favorable appearance upon completion can be provided.

Figure 7:
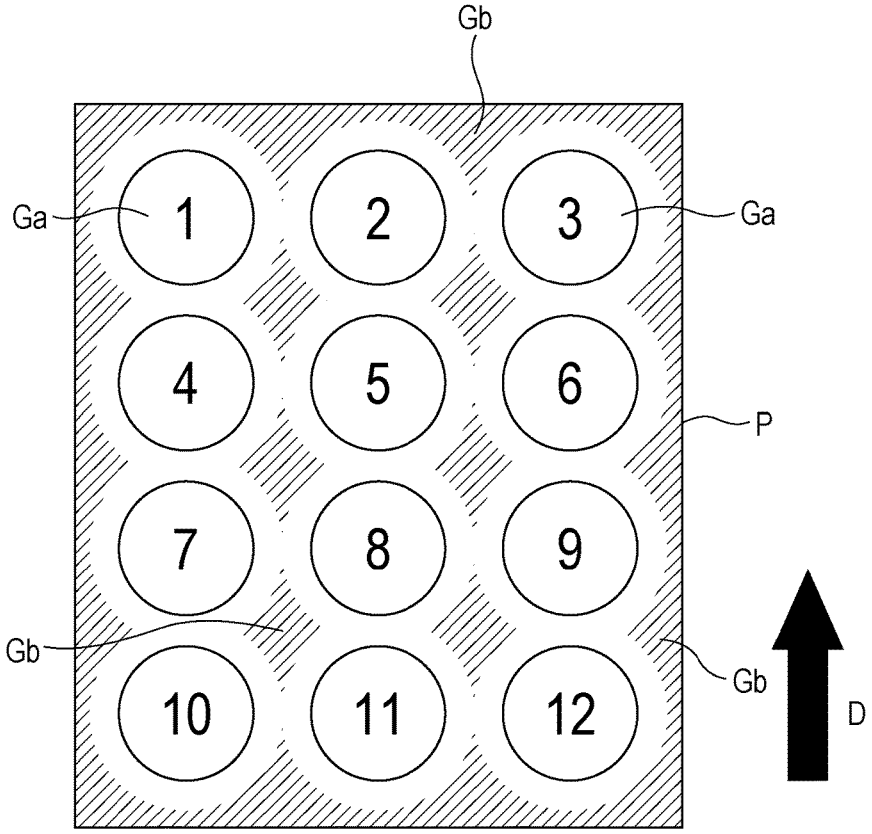
FIG. 7 is a view of a configuration example of the normal images and the image patterns for toner discharging in the first toner discharge sequence.

Note that in the first toner discharge sequence, each image pattern Gb for deteriorated toner discharging is the band-shaped pattern. However, the present invention is not limited to such a configuration. FIG. 7 illustrates another example of the configuration of the image pattern Gb for deteriorated toner discharging. As illustrated in FIG. 7, the image pattern Gb may be formed in the non-image formation region other than the images Ga1 to Ga12, i.e., an unnecessary portion of the paper roll P. In this case, the image pattern Gb is preferably formed with an annular region slightly larger than each of the images Ga1 to Ga12.

Second Embodiment

A second embodiment is different from the above-described first embodiment in that a user can select any of first and second discharge sequences when a serial printing distance L exceeds a second threshold Th2. Note that other configurations and functions of an image formation system 100 are similar to those of the above-described first embodiment. Thus, the same reference numerals are used to represent common components, and detailed description thereof will not be repeated.

Operation Example of Image Formation Device 300

Figure 8:
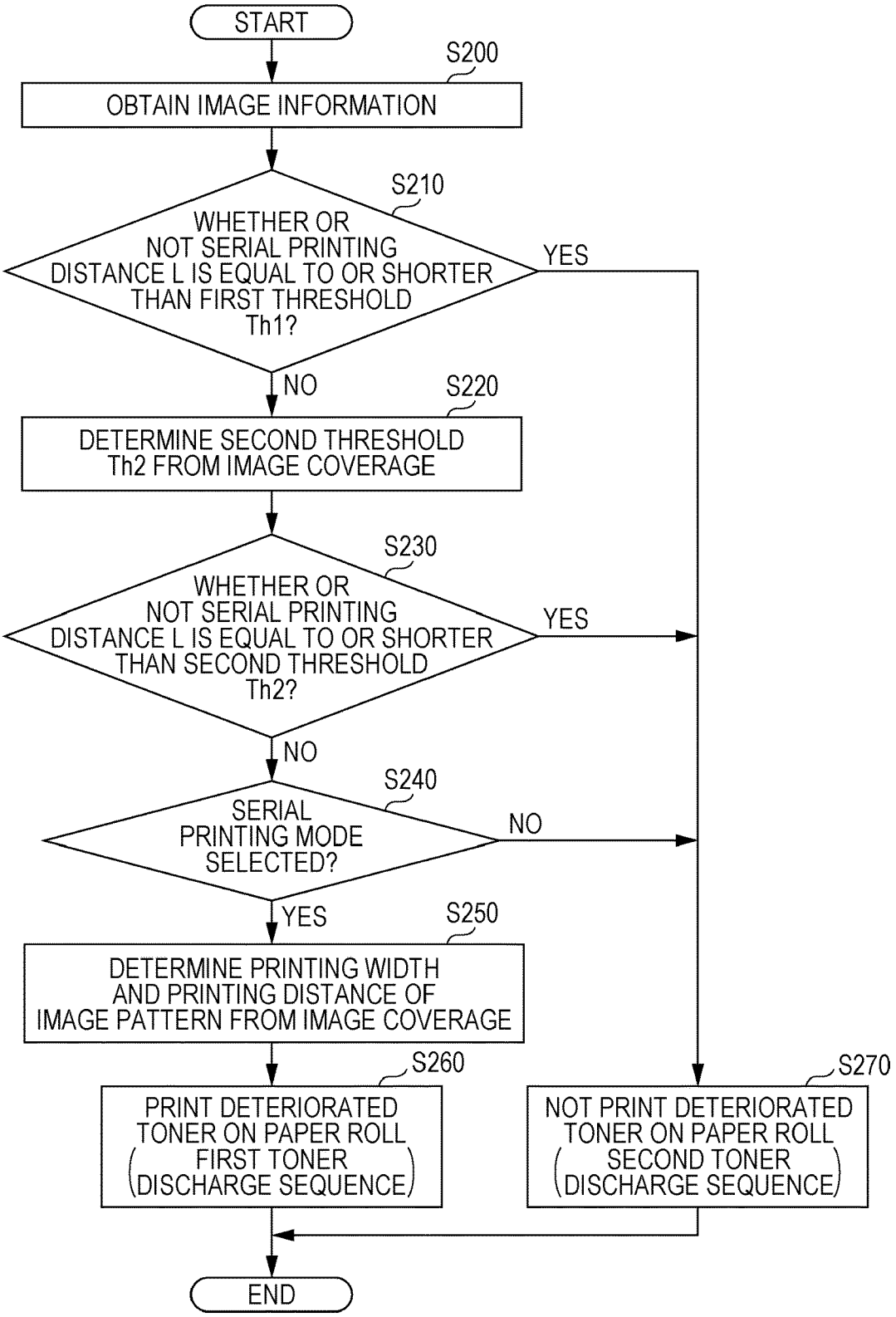
FIG. 8 is a flowchart of an operation example of an image formation system of a second embodiment of the present invention.

FIG. 8 is a flowchart of an example of operation of an image formation device 300 when deteriorated toner is discharged. A CPU 352 of the image formation device 300 executes software read from a ROM 354 to implement processing shown in the flowchart of FIG. 8. Note that processing of steps S200 to S230 and S250 to S270 is similar to the processing of the steps S100 to S160 of FIG. 4 described in the first embodiment, and therefore, detailed description thereof will not be repeated.

As shown in FIG. 8, when the serial printing distance L calculated for a job based on image information exceeds, at the step S230, the second threshold Th2, the processing proceeds to a step S240. At the step S240, a control section 350 determines whether or not a serial printing mode has been selected. The serial printing mode is a mode in which the user can manually select any of the first and second toner discharge sequences even when the serial printing distance L exceeds the second threshold Th2. This is because of the following reason: when the serial printing distance L exceeds the second threshold Th2, the first toner discharge sequence is normally selected, but the user might wish to give priority to an appearance after image printing and reduction in the distance of a consumed paper roll P over improvement of productivity by serial printing in the job. Note that the serial printing mode can be selected by, for example, selection and operation of a serial printing mode icon (button) displayed on an operation screen of an operation display section 360.

When the serial printing mode has been selected, the control section 350 executes the first toner discharge sequence of printing an image pattern for deteriorated toner discharging during serial printing operation. On the other hand, when it is determined that the serial printing mode has not been selected, the control section 350 executes the second toner discharge sequence of printing the image pattern for deteriorated toner discharging after serial printing has been stopped in the middle thereof. Afterward, the remaining job is executed. In the second embodiment, such processing is repeatedly executed.

As described above, according to the second embodiment, features and advantageous effects similar to those of the above-described first embodiment can be provided. That is, an image formation region where images Ga are printed can be expanded, and therefore, wasting of the paper roll P can be prevented. Moreover, according to the second embodiment, the normal printing mode is provided, and therefore, control for deteriorated toner discharging can be made with priority on user's wishes.

Note that the technical scope of the present invention is not limited to the above-described embodiments, and various changes can be made to the above-described embodiments without departing from the gist of the present invention. For example, in the above-described embodiments, the example where the present invention is applied to the image formation device 300 configured to form a color image as illustrated in FIG. 1 has been described, but the present invention is not limited to such an example. The present invention is also applicable to an image formation device configured to form a black-and-white image.

Moreover, in the above-described first and second embodiments, the example where the control section 350 of the image formation device 300 mainly performs the image formation processing in cooperation with control sections provided at the paper supply device 200 and the paper discharge device 400 has been described, but the present invention is not limited to such an example. For example, the control sections provided at the paper supply device 200 and the paper discharge device 400 can mainly perform the image formation processing in cooperation with other control sections.

In addition, in the above-described first and second embodiments, the example where the control section 350 determines whether or not the serial printing distance L is equal to or shorter than the first threshold Th1, and when the control section 350 determines that the serial printing distance L exceeds the first threshold T1, the control section 350 further determines whether or not the serial printing distance L is equal to or shorter than the second threshold Th2 has been described, but the present invention is not limited to such an example. For example, the control section 350 may determine whether or not the serial printing distance L is equal to or shorter than the second threshold Th2 without determining whether or not the serial printing distance L is equal to or shorter than the first threshold Th1. That is, the control section 350 may execute processing shown in the flowcharts of FIGS. 4 and 8 using the second threshold Th2 as the first threshold.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image formation device comprising:

an image formation section configured to develop, using toner, an electrostatic latent image formed on an image carrier based on job image information, thereby transferring a first image onto continuous paper;

a hardware processor configured to determine whether or not a serial printing distance is equal to or shorter than a first threshold, wherein the serial printing distance is a distance at which the first image is printed on the continuous paper, and control the image formation section to print the first image on the continuous paper when the serial printing distance is equal to or shorter than the first threshold, and to decrease the proportion of deteriorated toner in a developer by printing the first image and a second image on the continuous paper when the serial printing distance exceeds the first threshold, wherein the second image is based on an image information, different from the job image information.

2. The image formation device according to claim 1, wherein the first threshold is a value indicating a distance at which the first image is printable without discharging deteriorated toner regardless of a coverage of the first image.

3. The image formation device according to claim 2, wherein the coverage is contained in the image information.

4. The image formation device according to claim 1, wherein the hardware processor determines whether or not the printing distance exceeds the first threshold.

5. The image formation device according to claim 1, wherein the hardware processor controls the image formation section not to print the second image on the continuous paper when the printing distance is equal to or shorter than the first threshold.

6. The image formation device according to claim 1, wherein the image formation section includes an intermediate transfer belt and a cleaning section configured to remove toner from the intermediate transfer belt, and the hardware processor controls the image formation section to transfer the second image onto the intermediate transfer belt and remove the second image by the cleaning section under suspension of printing of the first image when the printing distance is equal to or shorter than the first threshold.

7. The image formation device according to claim 1, wherein the image information is transmitted from an external device.

8. The image formation device according to claim 1, wherein the hardware processor controls the image formation section to print, on the continuous paper, the first image and the second image when the printing distance exceeds a second threshold greater than the first threshold.

9. The image formation device according to claim 8, wherein the hardware processor determines the second threshold based on a coverage of the first image.

10. The image formation device according to claim 9, wherein the hardware processor increases the second threshold with an increase in the coverage.

11. The image formation device according to claim 1, wherein the hardware processor controls the image formation section to form the second image at an end portion of the continuous paper in a direction perpendicular to a delivery direction of the continuous paper.

12. The image formation device according to claim 1, wherein the hardware processor controls the image formation section to form the first image on an inner side of the second image.

13. The image formation device according to claim 1, wherein the hardware processor determines a printing width or a printing distance of the second image based on a coverage of the first image.

14. The image formation device according to claim 1, wherein when the printing distance exceeds a second threshold greater than the first threshold, the hardware processor determines, based on user's selection, whether the second image is, together with the first image, printed on the continuous paper to discharge deteriorated toner or the deteriorated toner is discharged without printing the second image on the continuous paper.

15. A non-transitory computer readable medium which includes an instruction for making an image formation device execute a toner discharging method, the method comprising:

determine whether or not a serial printing distance is equal to or shorter than a first threshold, wherein the serial printing distance is a distance at which a first image is printed on a continuous paper, the first image is based on job image information and control the image formation section to print the first image on the continuous paper when the serial printing distance is equal to or shorter than the first threshold, and to decrease the proportion of deteriorated toner in a developer by printing the first image and a second image on the continuous paper when the serial printing distance exceeds the first threshold, wherein the second image is based on an image information, different from the job image information.

* * * * *